US005953758A

United States Patent [19]

Foster

[11] Patent Number: 5,953,758

[45] Date of Patent: Sep. 21, 1999

[54] LONG-SLEEVED GARMENT WITH POCKETED SLEEVES FOR HAND WARMING AND STORAGE

[76] Inventor: David Vernam Foster, 10306 Meredith Ave., Kensington, Md. 20895

[21] Appl. No.: 09/018,849

[22] Filed: Feb. 4, 1998

[51] Int. Cl.[6] ..... A41D 27/10

[52] U.S. Cl. ..... 2/268; 2/270; 2/159

[58] Field of Search ..... 2/115, 247, 125, 2/108, 90, 16, 252, 79, 93, 97, 96, 268, 270, 85, 69, 272, 158, 159, 94, 126, 250

[56] References Cited

U.S. PATENT DOCUMENTS

| | | | |
|---|---|---|---|
| 2,134,425 | 1/1938 | West . | |
| 2,136,879 | 11/1938 | Haber et al. | 2/270 |
| 2,274,510 | 5/1942 | Wohl et al. | 2/270 |
| 3,193,842 | 7/1965 | Bell | 2/94 |
| 3,214,771 | 11/1965 | Treiber | 2/270 |
| 3,889,297 | 6/1975 | Jarboe . | |
| 4,159,792 | 7/1979 | Siegal . | |
| 4,275,468 | 6/1981 | Outlaw . | |
| 4,308,622 | 1/1982 | Maddron | 2/79 |
| 4,359,784 | 11/1982 | Harrington | 2/269 |
| 4,498,200 | 2/1985 | Livingstone . | |
| 4,756,027 | 7/1988 | Buenos et al. | 2/123 |
| 4,876,724 | 10/1989 | Suzuki | 2/94 |
| 4,980,929 | 1/1991 | Long | 2/125 |
| 5,033,127 | 7/1991 | Schmeltz | 2/269 |
| 5,042,091 | 8/1991 | Tonkens . | |
| 5,052,052 | 10/1991 | Gilford et al. | 2/2 |
| 5,088,116 | 2/1992 | Gould | 2/82 |
| 5,117,507 | 6/1992 | Long | 2/158 |
| 5,127,545 | 7/1992 | French . | |
| 5,157,791 | 10/1992 | Woodson . | |
| 5,173,968 | 12/1992 | Fox | 2/244 |
| 5,669,078 | 9/1997 | Scremin et al. | 2/247 |
| 5,718,000 | 2/1998 | Ost et al. | 2/69 |
| 5,794,268 | 8/1998 | Pessey | 2/227 |

*Primary Examiner*—John J. Calvert
*Assistant Examiner*—Tejash D Patel

[57] ABSTRACT

Pockets placed into or onto the sleeves of a long-sleeved garment for warming or protecting of hands. A pocket is disposed on each sleeve in the area of the forearm so that an individual can easily insert his or her right hand into the left sleeve pocket and correspondingly, insert his or her left hand into the right sleeve pocket. A closure device may be added to one or both pockets for the storage of loose items. In addition, the pockets can be turned inside out allowing the individual to insert his or her right hand into the right pocket and his or her left hand into the left pocket from within each respective sleeve. When used in this fashion, the pockets can be shaped in the form of mittens or other glove-like form so that the individual can use his or her hands while still keeping them warm and protected.

5 Claims, 2 Drawing Sheets

Fig. 1
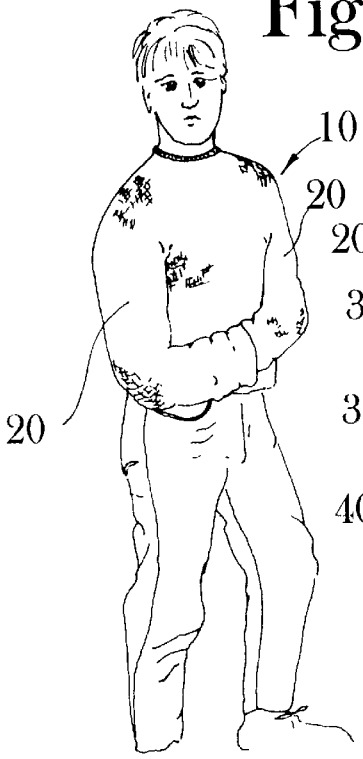
Fig. 2
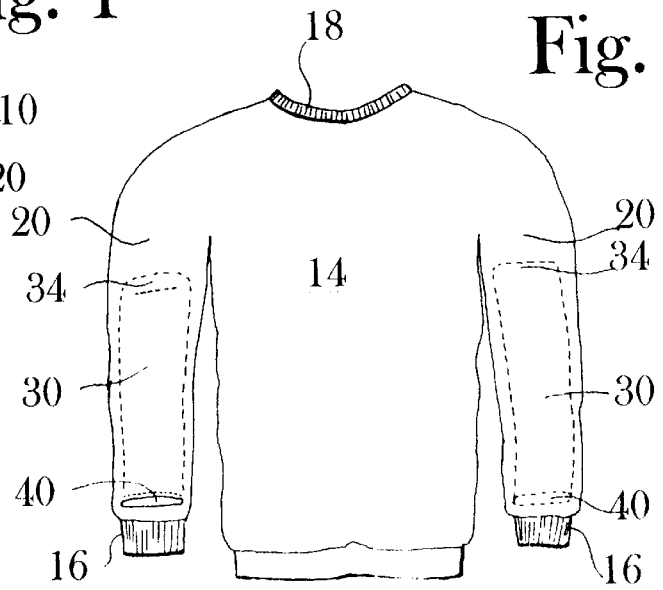
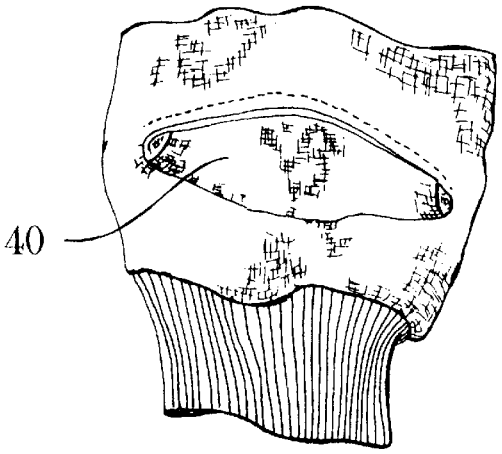
Fig. 3
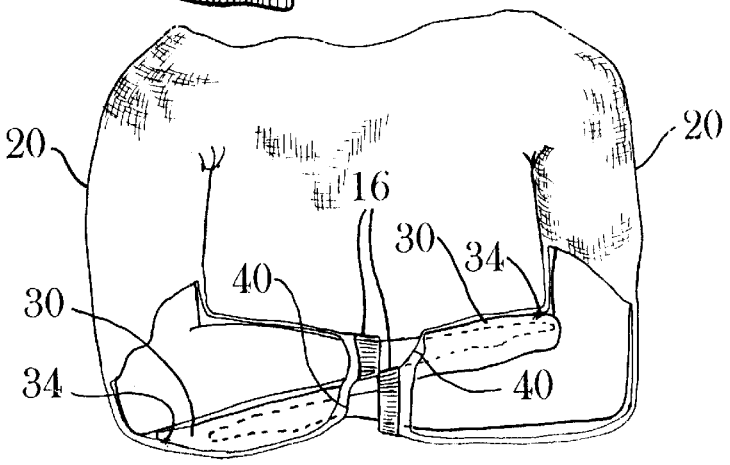
Fig. 4

LONG-SLEEVED GARMENT WITH POCKETED SLEEVES FOR HAND WARMING AND STORAGE

CROSS-REFERENCE TO RELATED APPLICATION

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND

1. Field of the Invention

This invention relates to long-sleeve garments with pocketed sleeves, specifically for use for warming and protecting an individual's hands or storing items.

2. Description of Prior Art

A common problem with known type long-sleeved garments is that, while such garments protect the upper torso and arms of the wearer, the hands are exposed to the elements. One inventor has attempted to address this problem for participants in sports and other outdoor activities. H. G. Outlaw, U.S. Pat. No. 4,275,468. The Outlaw patent permits individuals to warm their hands by placing them in small exterior pockets located just below the arm pits. This structure is arranged to allow individuals who need to have their hands uncovered by gloves or such to intermittently warm their hands. It is designed to maximize the use of body heat and afford protection from being tom by being caught by external objects.

It is common practice, particularly among women and children, whose hands are exposed to the cold to insert their ungloved hands into the opposite sleeves of long-sleeved garments. This practice also allows individuals who are not wearing gloves or such to intermittently warm their hands. External destruction is often not a concern. Insertion of the hands in opposite sleeves is comfortable and convenient, though the practice over time will result in excessive stretching of the sleeve cuffs.

The Outlaw patent does not accommodate this common practice of inserting ungloved hands into the opposite sleeve. Instead, it requires individuals to place their hands just below the armpits, an area of the body that it is often sweaty and odorous, particularly if the individual is engaged in an outdoor sport. Also, to fully insert both hands simultaneously into the pockets on each side of the individual's upper torso is often difficult and uncomfortable, especially for women that may have a large bust.

Furthermore, the Outlaw patent does not warm or protect an individual's hands when he or she is using them. When an individual is warming and protecting his or her hands, it is convenient to have the option of using his or her hands while still keeping them warm and protected. The Outlaw patent is specific in having an individual's hands unencumbered, by such devices as gloves and the like, when participating in an activity.

It is also common practice for people who wear long sleeve garments to store tissues, napkins, handkerchiefs or other loose items in their sleeves. Two inventors have addressed putting a concealed pouch in the sleeve of a garment for the purpose of retaining and concealing small personal valuables. J. Livingstone, U.S. Pat. No. 4,498,200 titled, "Garment Having Concealed Pouch," and M. E. West, U.S. Pat. No. 2,134,425 titled, "Sleeve Pocket Structure." The Livingstone patent only allows for the pockets to be located in the cuff of the sleeve located along the stitching line, as opposed to elsewhere on the sleeve. The West patent allows for a pocket on the sleeve but only where the entrance of the pocket is located along the seam of the sleeve panel, as opposed to on the sleeve panel itself. Neither the Livingstone patent nor the West patent accommodate the use of the pockets for warming of hands.

Other inventors have created several types of alternative pockets suitable for transporting loose items. These patents include R. R. Tonkens, U.S. Pat. No. 5,042,091 titled, "Garment Tissue Dispenser and Method," R. T. French, U.S. Pat. No. 5,127,545 titled, "Pouch for Holding and Dispensing Facial Tissues," and R. D. Woodson, U.S. Pat. No. 5,157,791 titled, "Sock Having Knitted Carry-All Compartment and Method of Making Thereof." However, these inventions as well as the Outlaw garment, do not accommodate the practice of storing loose items in sleeves.

Overall, none of the prior art patents listed above offer the new and novel features of the subject invention.

BRIEF SUMMARY OF THE INVENTION

The present invention has the following objects and advantages:

(a) To provide a long sleeved garment with a hand warmer structure that permits an ungloved wearer to readily, as well as intermittently, warm and protect his or her hands in a comfortable and practical position.

(b) To provide a means for inserting ungloved hands in the respective opposite sleeve of a long-sleeved garment;

(c) To provide a means of inserting ungloved hands into opposite sleeves that does not stretch the sleeve cuffs;

(d) To provide a means for the ungloved wearer to use his or her hands while still keeping them warm and protected; and (e) To provide a means for storing loose items in one's sleeves in a manner that retains the loose items and does not stretch the sleeve cuffs.

Still further objects and advantages will become apparent from a consideration of the ensuing description and drawings.

BRIEF DESCRIPTION OF THE DRAWINGS

FIG. 1 is a perspective of the jersey of this invention as in use;

FIG. 2 is a frontal view of the jersey per se;

FIG. 3 is a fragmentary portion of the sleeve near the area of the cuff of the jersey;

FIG. 4 is fragmentary portion showing how the hands are inserted into the respective opposite sleeve.

Figure 5:
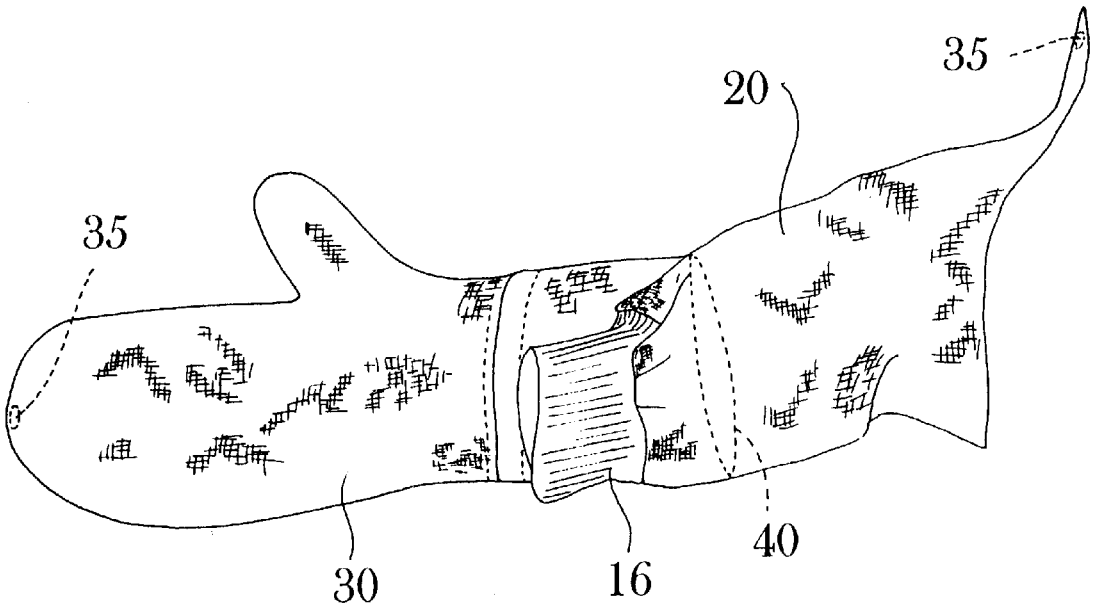
FIG. 5 is a fragmentary portion showing how the hands are inserted into the pockets when they are turned inside out. In this drawing, the pockets are shaped in the form of mittens.

| Reference Numerals In Drawings |
|---|
| 10 jersey in general |
| 14 part of jersey covering upper torso |
| 16 sleeve cuffs |
| 18 neck opening |
| 20 sleeve |
| 30 pocket |
| 34 top of pocket |
| 35 device to attach pocket to sleeve |
| 40 entrance of pocket |

DETAILED DESCRIPTION—FIGS. 1 to 5

FIG. 1 shows in general the jersey 10 of this invention as being used by an individual.

FIG. 2 shows the jersey per se with the upper body covering portion 14, sleeves 20 attached thereto, with sleeve cuffs 16, and a neck opening 18. The hand warming pocket is indicated by reference numeral 30. The hidden stitching shows each of the pockets 30 being located inside each sleeve 20. The entrance of the pocket 40 is located on the outside of the sleeve near the expansion cuff 16. The top of the pocket 34 is attached by stitching or by other means to the inside of the sleeve 20. A manufacturer may use the same or similar material near the entrance of the pocket to make the pocket less noticeable and a different material for the rest of the pocket for extra warmth and protection. A manufacturer may also decide to attach the pockets 30 onto the sleeves 20 by stitching, adhesive or other means, instead of inserting the pockets into the sleeves 20.

FIG. 3 shows the entrance of the pocket 40. The pocket is attached to the long-sleeved garment by stitching, adhesive or other means inside the sleeve 20.

FIG. 4. shows an interior view of an individual's right hand inserted into the right sleeve pocket 30 and the left hand inserted into the right sleeve pocket 30. The entrance of one pocket 40 is located above the forearm on one sleeve 20 and the entrance to the other pocket 40 is located below the forearm on the opposite sleeve 20.

FIG. 5 shows the option of when an individual turns the pocket 30 inside out and inserts his or her hand into the pocket 30 through the entrance 40 from within the sleeve 20. When used in this fashion, a manufacturer may decide to shape the pockets in the form of mittens or other glove-like form.

DETAILED DESCRIPTION OF THE OPERATION OF THE INVENTION

An individual wearing a long-sleeved garment, such as a jersey or sweater, would insert their right hand through the outside entrance of the left pocket 40 located in the sleeve 20 near the sleeve cuff 16 on top of the forearm into the pocket 30. Their left hand would be inserted through the outside entrance of the right pocket 40 located in the sleeve 20 located near the expansion cuff 16 below the forearm into the other pocket. The location of the pockets 30 can be reversed so that the pocket 30 on the right sleeve 20 is on top of the forearm and the pocket 30 on the left sleeve 20 is below the forearm. The entrances to the pockets on each sleeve 20 are on opposite sides of the individual's forearm to so that when both hands are inserted into the pockets 30 simultaneously the hands will cross over one another, each in its respective pocket with one forearm resting comfortably on top of the other as shown in FIG. 4.

When the pocket 30 is inserted into the sleeve 20, the top of the pocket 34 is stitched or attached to the sleeve 20 by some other means so that the pocket does not bunch up. Also, the top of the pocket 34 is attached to the sleeve 20 so as to prevent the pocket 30 from obstructing an individual's hand from easily sliding through the sleeve 20 and out the sleeve cuff 16 when the individual is putting on the long-sleeved garment. A manufacturer may decide to insert a liner around the pocket 30 to ensure that the pocket 30 does not obstruct the individual's hand from easily sliding through the sleeve 20.

The invention can be easily modified so that an individual has the option of using his or her hands while still keeping them warm and protected. If a manufacturer were not to stitch the top part of the pocket 34, but instead used a device 35, such as a snap, a button, or VELCRO®, an individual could temporarily remove the top of the pocket 34 from its fixed position and turn the pocket inside out. An individual could then insert his or her right hand through the entrance 40 of the right pocket from within the sleeve 20 into the right pocket 30 and insert his or her left hand through the entrance 40 of the left pocket from within the sleeve 20 into the left pocket 30. This option is demonstrated in FIG. 5. Also, an individual being able to turn the pockets 30 inside out allows for better cleaning and maintenance.

For individuals wanting to store tissues, handkerchiefs, napkins or other loose items, they can simply insert the loose item through the entrance of the pocket 40 into the pocket 30. For tissues and the like, the sides of the pocket will hold the item in place. For other heavier items, a manufacturer may include a closing device, such as a snap, a button, a zipper or VELCRO®, at the entrance of the pocket 40 to prevent these items from falling out of the pocket 30.

CONCLUSION, RAMIFICATIONS, AND SCOPE

This invention will warm and protect the hands of an individual in inclement weather, such as rain or snow, while he or she is engaged in a wide range of activities. The individual has the option of either inserting his or her hands into the pockets located in the opposite sleeve or directly into the pocket of the same sleeve when the pockets are turned inside out. With this latter option, an individual would have greater use of his or her hands, particularly when the pocket is shaped into a mitten or other glove-like form. This invention can be used by an individual engaged in outdoor activities, such as running, football, soccer, hunting, golf, or military activities. It can also be use by an individual engaged in indirect outdoor participation, such as a spectator, statistician, trainer, team physician, band member, reporter, photographer or cheerleader. Many of these indirect participants also benefit from hand warming for use of such items as a laptop computer, camera, musical instrument, cheerleading prop, or medical equipment. Furthermore, it can be used indoors by an individual engaged in such indirect activities as watching television. This invention has many advantages over the prior art:

- it is more comfortable for an ungloved individual to warm and protect both hands simultaneously;
- it provides warmth and protection for ungloved hands in an area of the body that is far less sweaty and odorous;
- when the pockets are inserted into the sleeves, they are less noticeable, since only the entrance of the pocket is visible on the outside of the long-sleeved garment and the rest of the pocket is hidden from view beneath the surface of the sleeve;
- it allows an individual the option to use their hands while still keeping them warm and protected; and
- it can be used for storage of tissues handkerchiefs, napkins or other loose items.

Although the description above contains many specificities, these should not be construed as limiting the scope of the invention by merely providing illustrations of some of the presently preferred embodiments of this invention. The scope of this invention should be determined by the appended claims and their legal equivalents, rather than by the examples given.

I claim:

1. A long-sleeve garment to be worn by individuals who are engaged in activities while not wearing gloves, comprising:

an upper body casing made of warm material;

sleeves on said body casing for encasing the arms of the wearer;

pockets for warmth and protection placed into said sleeves located in the area of the forearm;

pockets for warmth and protection placed onto said sleeves located in the area of the forearm;

entrances of said pockets are located in the sleeve panel of the long-sleeved garment;

and entrances of said pockets are located on the sleeve panel of the long-sleeved garment.

2. A long-sleeved-garment as recited in claim 1, wherein:

said pockets can be turned inside out and an individual can insert his or her right hand into the right pocket and his or her left hand into the left pocket from within each respective sleeve.

3. A long-sleeve garment as recited in claims 1, wherein:

said pockets are shaped in the form of mittens.

4. A long-sleeved garment as recited in claim 1, wherein:

said pockets are in the form of gloves.

5. A long-sleeved garment as recited in claim 1, wherein said pockets are used to store loose items, further comprising:

a means for closing the entrance of said pockets.

* * * * *